US005781886A

United States Patent [19]

Tsujiuchi

[11] Patent Number: 5,781,886

[45] Date of Patent: Jul. 14, 1998

[54] VOICE RESPONSE APPARATUS

[75] Inventor: Hidetoshi Tsujiuchi, Kawasaki, Japan

[73] Assignee: Fujitsu Limited, Kawasaki, Japan

[21] Appl. No.: 581,332

[22] Filed: Dec. 29, 1995

[30] Foreign Application Priority Data

Apr. 20, 1995 [JP] Japan ..... 7-095066

[51] Int. Cl.[6] ..... G10L 3/00

[52] U.S. Cl. ..... 704/275; 704/270

[58] Field of Search ..... 395/2.79, 2.84; 380/9; 358/403; 704/270, 275

[56] References Cited

U.S. PATENT DOCUMENTS 5,196,943 3/1993 Hersee ..... 358/403
5,524,051 6/1996 Ryan ..... 380/9

OTHER PUBLICATIONS stifelman et al, VoiceNotes: Speech Interface for handheld Notetake, ACM 0-89791, pp. 179-186, Apr. 29, 1993.

*Primary Examiner*—David R. Hudspeth
*Assistant Examiner*—Robert Sax
*Attorney, Agent, or Firm*—Staas & Halsey

[57] ABSTRACT

A voice response apparatus and method in which narrative text contained in a database is presented to a user through a telephone. Based on user responses, the voice response apparatus selects only the appropriate text which matches the user's selection. The user has the option of listening to a human voice synthesized by the system reciting the text or having the text and corresponding graphics faxed to him. At any point during the recitation of text, the user may select certain options made available by the system. These options include among many: increasing the speed of the voice reciting the text; decreasing the speed of the voice reciting the text; listening to a summary of the text rather than the full text; discontinuing recitation of the text; and switching to a different text. The system, upon detection of a user option selection, marks a position in the text and continues the recitation from that point when appropriate depending on the option selected.

19 Claims, 14 Drawing Sheets

FIG. 2

| | |
|---|---|
| TEXT DATA | ko re ha ON SEI GOU SEI de su. |
| | ⇩ |
| WORD SEGMENTATION | ko re/ha/ON SEI/GOU SEI/de su. |
| ARTICULATION SETTING | ko re ha/ON SEI GOU SEI de su. |
| | ⇩ |
| READ IMPARTMENT | ko re/wa/o'nse-/go-se/de/su/. |
| PROSODIC SYMBOL IMPARTMENT | korewa, onse-go' -se-desu. |
| | ⇩ |
| INTONATION PATTERN GENERATION | korewa, onse-go' -se-desu. |
| | ⇩ |
| WAVEFORM SYNTHESIZATION USING PHONEMIC ELEMENTS | Q+k+O+r+E+w+A+Q<br>O+N+s+E+E+g+O+O+s+E+E+d+E+s+U |

FIG. 3

| DELETE | SEQ | ADDRESS | SCALE | RECRUIT | INDUSTRIAL CLASSIFICATION | TYPE OF JOB | MINIMUM WAGES | MAXIMUM WAGES | STARTING TIME | ENDING TIME |
|---|---|---|---|---|---|---|---|---|---|---|
| | 1 | SHINJUKU-KU | 100 | 7 | CONSTRUCTION INDUSTRY | PAINTER | 375,000 | 470,000 | 09:00 | 18:00 |
| | 2 | NAKANO-KU | 150 | 1 | EQUIPMENT ENTERPRISE | PLUMBER | 400,000 | 550,000 | 08:30 | 17:30 |
| | 3 | SHIBUYA-KU | 11 | 3 | CONSTRUCTION INDUSTRY | ARCHITECT | 350,000 | 600,000 | 10:00 | 19:00 |
| | 4 | SUGINAMI-KU | 250 | 3 | SERVICES | SALESMAN | 225,000 | 450,000 | 10:00 | 18:00 |
| | 5 | SHNJUKU-KU | 15 | 1 | SERVICES | DOOR-TO-DOOR SALESMAN | 415,000 | 550,000 | 17:00 | 22:00 |
| | 6 | SHINJUKU-KU | 31 | 1 | SERVICES | SELLER | 220,000 | 440,000 | 10:00 | 18:00 |

FIG. 4

| PROCEDURE NUMBER | PROCESSING CLASSIFICATION | OPERAND |
|---|---|---|
| 1 | (1) | open.pcm (GOODS ORDERING SERVICE GUIDE NARRATION) |
| 2 | (1) | [INPUT THE USER NUMBER, PLEASE.] |
| 3 | (2) | Code-user (COMPLETION OF DATA INPUT IS DETERMINED WITH 6-DATA) |
| 4 | (3) | RETRIEVE SUCH A USER NAME THAT THE USER NUMBER IS Code-user FROM USER DATABASE AND STORE IT AS Name-user. |
| 5 | (1) | [NUMBER Code-user, ARE YOU Name-user ?] |
| 6 | (2) | TO PROCEDURE 7 IF THE PUSH BUTTON IS "1"<br>TO PROCEDURE 2 IF THE PUSH BUTTON IS "9" |
| 7 | (1) | [INPUT GOODS NUMBER, PLEASE.] |
| 8 | (2) | Code-goods (COMPLETION OF DATA INPUT IS DETERMINED WITH 3-DATA) |
| 9 | (3) | RETRIEVE SUCH A GOODS NAME THAT THE GOODS NUMBER IS Code-goods AND STORE THE NAME AS Name-goods |
| 10 | (1) | [Code-goods NUMBER, ARE YOU Name-goods ?] |
| 11 | (2) | TO PROCEDURE 12 IF THE PUSH BUTTON IS "1"<br>TO PROCEDURE 7 IF THE PUSH BUTTON IS "9" |
| 12 | (1) | [INPUT THE NUMBER OF ORDERS, PLEASE.] |
| 13 | (2) | Num-goods (COMPLETION OF DATA INPUT IS DETERMINED WITH # INPUT) |
| 14 | (3) | ADD SUCH TEXT DATA THAT [I ORDER Num-goods NUMBERS OF Name-goods HAVING Code-goods NUMBER] TO order.ext. |
| 15 | (1) | [IS THAT ALL RIGHT ?] |
| 16 | (2) | TO PROCEDURE 17 IF THE PUSH BUTTON IS "1"<br>TO PROCEDURE 7 IF THE PUSH BUTTON IS "9" |
| 17 | (1) | order.txt |
| 18 | (1) | [CAN WE ORDER ?] |
| 19 | (2) | TO PROCEDURE 20 IF THE PUSH BUTTON IS "1"<br>TO PROCEDURE 22 IF THE PUSH BUTTON IS "9" |
| 20 | (1) | [WE HAVE ORDERED.] |
| 21 | (3) | WRITE THE CONTENT OF ORDER TO GOODS DATABASE |
| 22 | (1) | close.pcm (SERVICE TERMINATING NARRATION) |

FIG. 10

| $F_{SPD}$ | $F_{MODE}$ | READING MODE |
|---|---|---|
| 1 | 1 | READ ESSENTIAL POINT SLOWLY |
| 1 | 0 | READ WHOLE SENTENCES SLOWLY |
| 2 | 1 | READ ESSENTIAL POINTS AT NORMAL SPEED |
| 2 | 0 | READ WHOLE DOCUMENTS AT NORMAL SPEED |
| 3 | 1 | READ FAST ESSENTIAL POINTS |
| 3 | 0 | READ FAST WHOLE DOCUMENTS |

FIG. 14

| | | RECORDED SPEECH COMPILING METHOD | PARAMETER EDITING METHOD | RULE SYNTHESIZING METHOD |
|---|---|---|---|---|
| VOICE QUALITY | UNDERSTANDABILITY | HIGH | HIGH | MIDDLE |
| | NATURALNESS | HIGH | MIDDLE | LOW |
| NUMBER OF VOCABULARIES | | SMALL | LARGE | INFINITE |
| APPARATUS | | SIMPLE | COMPARATIVELY COMPLICATED | COMPLICATED |

VOICE RESPONSE APPARATUS

BACKGROUND OF THE INVENTION

The present invention relates generally to a voice response apparatus for performing a voice response service and more particularly, to a voice response apparatus for sending voice signals via communication lines such as common telephone lines.

With advancements in speech synthesizing technology and a speech recognizing technology in recent years, there are voice response systems capable of performing services such as reserving seats or inquiring into account balances through no human intermediary.

Such voice response systems consist of a voice response apparatus, telephones and telephone lines for transmitting data therebetween. In the voice response apparatus, several pieces of data for determining contents of the voice responses are prepared. The voice response apparatus selects the data in accordance with the information that the user inputs through the telephone and converts the selected data into voice signals transmitting the voice signals through the telephone.

The data prepared in the voice response apparatus take a variety of forms such as text data, waveforms, data into which the voice waveform is coded and data into which the voice waveform is parameterized by analysis. In the voice response apparatus, the data is converted into voice signals by use of a method corresponding to the data format. For example, the voice response apparatus having text data that determines contents of the response messages synthesizes the voice signals by a rule synthesizing method from the text data.

Further, the methods of inputting information from the user telephone comprises a method using tone signals and a method using a human voice uttered by the user. In a voice response apparatus using the latter method, speech recognition technology is used to judge the contents of the voice.

In such a voice response apparatus, a variety of contrivances are used to perform high-quality voice response. For example, a vice response apparatus disclosed in Japanese Patent Laid-Open Publication No. 59-181767 judges the transmission condition by detecting the level of voice signals from the telephone, and changes the level of voice signal transmission so as to output a fixed level voice from the telephone. Another voice response apparatus aiming at outputting a fixed level voice from the telephone is disclosed in Japanese Patent Laid-Open Publication No. 61-235940. The voice response apparatus in this Publication changes the transmitted level of voice signals in accordance with a depressed push button in the telephone.

Furthermore, a voice response apparatus capable of selecting a characteristic of the voice output and an utterance speed is disclosed in Japanese Patent Laid-Open Publication No. 4-175046. This voice response apparatus adopts voice synthesis based on a rule synthesizing method and it selects a set of parameters which are used in synthesizing voices, in accordance with the depressed push button.

Japanese Patent Laid-Open Publication No. 3-160868 discloses a voice response apparatus adopting a voice recognition technology. This voice response apparatus is prepared with two response sequences for the same service. In one response sequence, operating procedures are specified with which a numerical value of N figures is obtained in one step. And in another response sequence, operating procedures are specified with which the numerical value is obtained in N steps.

The voice response apparatus performs the service by obeying the response sequence in accordance with recognizability of words spoken by a user. When a user utters words in a recognizable form, the apparatus operates obeying the former response sequence and gets numerical data of some figures by one word. On the other hand, the apparatus operates obeying the latter response sequence to a user with low recognizability.

As explained above, the conventional voice response apparatuses have employed a variety of contrivances to provide the voice response service with a higher usability. In the case of a voice response service which employs a large-capacity database if there are a multiplicity of pieces of data in the database matching a retrieval condition, it follows that the information voice outputs beyond the recognizing ability of the given user, with the result that the information service does not function well and the apparatus outputting all data in the database that matches the retrieval condition.

Such a phenomenon can be prevented by repeating a question/answer process several times when offering the voice response service. If the voice response apparatus is constructed for that purpose, however, the user has to frequently respond (e.g. manipulate the push button) corresponding to a content of the inquiry provided by the voice response apparatus. Besides, the inquiries from the voice response apparatus often include some useless questions (to give an answer "Yes" in majority of cases), and, therefore, an effective voice response service can not be offered.

SUMMARY OF THE INVENTION

It is a primary object of the present invention to provide a voice response apparatus capable of actualizing an effective voice response service.

A voice response apparatus according to the present invention is an apparatus connected via a communication line to a user telephone. The voice response apparatus comprises a storage part, a transmitting unit and a control unit. The storage part stores narrative information of which the user should be notified. The transmitting unit generates a voice signal corresponding to narrative information stored in the storage part and transmits the generated voice signal onto the communication line. When position specifying data is input from the user telephone during the transmission of the narrative information, a control unit causes the transmitting unit to interrupt the transmission of the narrative information and to resume the transmission of the narrative information from a position specified by the position specifying data.

The voice response apparatus, according to the present invention, is capable of causing the transmitting unit to transmit narrative information from the position the user desires through the control unit.

Further, the narrative information can be composed of one or more pieces of document data the usage sequence of which is predetermined. In this case, the transmitting unit is constructed to generate the voice signals corresponding to each piece of document data constituting the narrative information in the order based on the usage sequence that is predetermined within the narrative information. Then, the control unit is constructed to receive an input position specifying data for specifying one piece of document data constituting the narrative information and resumes the transmission of the narrative information from the document data specified by document data specifying data.

In the case of adopting such a construction, the control procedures of the transmitting unit by the control unit can be simplified, and it is therefore possible to actualize the voice response apparatus capable of performing the effective voice response service.

According to the present voice response apparatus, any kind of signal may be used as position specifying data. When tone signals are employed as the position specifying data, it is feasible to actualize the voice response apparatus capable of performing the effective voice response service with a simple construction.

Further, the narrative information stored in the storage device may be composed of one or more pieces of document data the usage sequence of which is determined and output control data which determines whether or not each document data is output in the form of voice signals. In this case, the transmitting unit is constructed to generate the voice signals corresponding to each document data implying that the output control data is output in the form of the voice signals among the document data constituting the narrative information. Added further to the apparatus is a rewriting part for rewriting, when a predetermined piece of first indication data is input from the user telephone during the transmission of the narrative information by the transmitting unit, the output control data relative to the document data transmitted by the transmitting unit in the narrative information stored in the storage part into a piece of data indicating that the voice signal output is not performed. In this case, the voice output of unnecessary narrative information can be omitted.

When a predetermined piece of second indication data is input from the user telephone during the transmission of the narrative information by the transmitting unit, the rewriting part rewrites the content of the output control data relative to all the document data in the narrative information into a piece of data indicating that the voice signal output is performed.

Further, the storage part may store first narrative information and second narrative information used for the same service. In this instance, the transmitting unit is constructed to generate the voice signals corresponding to one of the first narrative information and the second narrative information stored in the storage part. Added then to the voice response apparatus is a switching unit for switching, when a predetermined piece of third indication data is input from the user telephone, the narrative information used for the transmission by the transmitting unit.

If constructed in this way, the content of the narrative information can be transmitted from the position that the user desires to the transmitting unit in a user-desired mode. Furthermore, a content specified in the second narrative information is a summary of a content specified in the first narrative information. With this arrangement, redundant voice output of the narration which is deemed useless to the user can be prevented.

Also, the transmitting unit is so constructed as to be capable of generating the voice signals having the same utterance speed based on the same narrative information. When receiving an indication to change the utterance speed from the user telephone during the transmission of the narrative information by the transmitting unit, the control unit will cause the transmitting unit to generate the voice signal having the utterance speed according to the user's indication. Therefore, the reading speed of the narration can be changed to a speed that the user desires.

Further, there may be used the narrative information the content of which is defined by the text data. In this instance, the voice response apparatus incorporates the transmitting unit for converting the narrative information into the voice signals by performing rule voice synthesis. Via this mechanism, any kind of narration can be voice-output, and the voice response apparatus can easily change the contents of the narration.

Furthermore, the storage part stores the narrative information the content of which is defined by the text data and the accumulation voice data. In this case, however, the transmitting unit converts the narrative information into the voice signals by performing rule voice synthesis. This is done when transmitting the narrative information the content of which is defined by the text data and to convert the narrative information into the voice signals by effecting waveform reproduction when transmitting the narrative information the content of which is defined by the accumulation voice data.

If the voice response apparatus is thus constructed, with respect to the narration requiring no change in the content, the content thereof is stored in the form of the accumulated voice data. When the narration requires a change of content, this changed content can be stored in the form of the text data. Accordingly, an average voice quality when offering the voice response service can be enhanced in terms of its understandability and naturalness as well.

Added to the voice response apparatus constructed to use the narrative information the content of which is defined by the text data are a database and retrieving part for creating a narrative information on the basis of a retrieval result of the database in accordance with a content of the indication from the user telephone and causing the storage part to store the thus created narrative information. If constructed in this way, the voice response apparatus capable of offering the data retrieval service can be obtained.

Added further to the voice response apparatus constructed to us the narrative information the content of which is defined by the text data is a facsimile signal transmitting part. The voice response apparatus can create image data on the basis of the narrative information to be transmitted by the transmitting unit and transmitting facsimile signals corresponding to the created image data onto the communication line.

In the case of taking this construction, the large-capacity data that are hard to recognize through the voice output can be output to the facsimile. For this reason, the voice response apparatus capable of offering the effective voice response service can be obtained.

Furthermore, when using the narrative information composed of one or more pieces of document data, the position specifying data the input of which is accepted by the control unit desirably contains the following: a portion of position specifying data for specifying the document data that is being transmitted; a portion of position specifying data for specifying a portion of document data next to the document data that is being transmitted; a portion of position specifying data for specifying a piece of document data positioned one anterior to the document data that is being transmitted; a portion of position specifying data for specifying the head document data of the narrative information that is being transmitted; and a portion of position specifying data for specifying the last document data of the narrative information that is being transmitted.

BRIEF DESCRIPTION OF THE DRAWINGS

Other objects and advantages of the present invention will become apparent during the following discussion in conjunction with the accompanying drawings, in which:

FIG. 2 is an explanatory chart showing operating contents of a voice synthesizing unit provided in the voice response apparatus in the first embodiment of the present invention;

FIG. 3 is an explanatory chart showing a structure of a result-of-retrieval file created in the voice response apparatus in the first embodiment of the present invention;

FIG. 4 is an explanatory chart showing an outline of a narration story file for a goods ordering service that is used in the voice response apparatus in the first embodiment of the present invention;

FIG. 10 is an explanatory diagram showing a relationship of a reading position control parameter versus a reading mode in the voice response apparatus in the first embodiment of the present invention;

FIG. 14 is a characteristic comparative chart on the basis of a voice synthesizing method usable in the voice response apparatus according to the present invention.

DESCRIPTION OF THE PREFERRED EMBODIMENTS

A voice response apparatus according to the present invention will be discussed in detail with reference to the accompanying drawings.

First Embodiment

Figure 1:
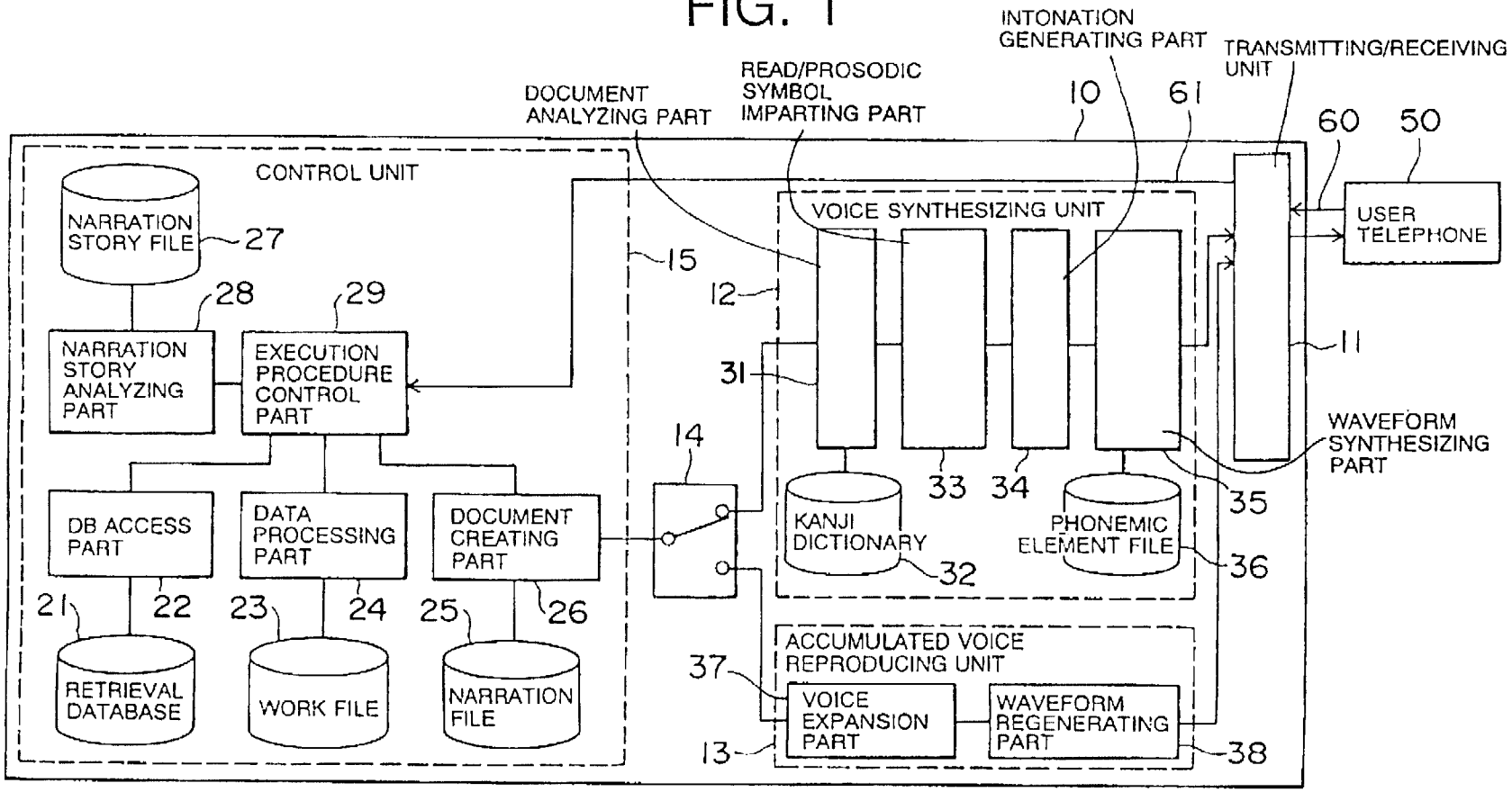
FIG. 1 is a block diagram illustrating a construction of a voice response apparatus in a first embodiment of the present invention.

FIG. 1 illustrates a voice response apparatus in a first embodiment of the present invention. As depicted therein, a voice response apparatus 10 in accordance with this embodiment includes a transmitting/receiving unit 11, a voice synthesizing unit 12, an accumulated voice reproducing unit 13, a switching unit 14 and a control unit 15.

The transmitting/receiving unit 11 transmits and receives signals to and from user telephones 50 connected via telephone lines. This transmitting/receiving unit 11 also executes a process (so-called network control) for a call signal from the user telephone 50. Further, the transmitting/receiving unit 11, when receiving a tone signal 60 from the user telephone 50, generates a portion of push button data 61 defined as code data corresponding to that tone signal 60 and supplies the control unit 15 with the thus generated push button data 61.

The voice synthesizing unit 12 generates voice signals corresponding to the text data containing ideographs. The voice synthesizing unit 12 is constructed of a document analyzing part 31, a word dictionary 32, a read/prosodic symbol imparting part 33, an intonation generating part 34, a waveform synthesizing part 35 and a phonemic element file 36. Those respective parts operate as schematically shown in FIG. 2.

The document analyzing part 31 segments text data input via the switching unit 14 from the control unit 15 into words with reference to the kanji (Chinese ideographs) and also sets an articulation in a group of data-segmented words. The read/prosodic symbol imparting part 33 devoices vowels with respect to the text data undergoing the word segmentation and the articulation setting. Thereby the read/prosodic symbol imparting part imparts the read and the prosodic symbols representing pauses, intonations and accents of the articulations to the text data. The intonation generating part 34 generates an intonation pattern with respect to the input text data on the basis of various items of data supplied from the read/prosodic symbol imparting part 33. The waveform synthesizing part 35 synthesizes waveforms by reading necessary phonemic elements out of the phonemic element file 36 and outputs a result of the waveform synthesization in the form of a voice signal.

This voice synthesizing unit 12 is so constructed as to be capable of generating the voice signals at different reading speeds (utterance speeds) on the basis of the text data given. The voice synthesizing unit 12 generates a voice signal at a reading speed corresponding to a value of a parameter "$F_{SPD}$" supplied for the control unit 15. Procedures of causing the voice synthesizing unit 12 to change the reading speed will hereinafter be described in detail.

The accumulated voice reproducing unit 13 converts voice coded data into a voice signal. The accumulated voice reproducing unit 13 is constructed of a voice expansion part 37 for expanding the voice coded data and a waveform regenerating part 38 for regenerating waveforms on the basis of the expanded voice coded data.

The voice signals output from the voice synthesizing unit and the accumulated voice reproducing unit 13 are input to the transmitting/receiving unit 11. The thus input voice signals are transmitted via the transmitting/receiving unit 11 onto a communication line and further transmitted to the user telephone 50.

The switching unit 14 supplies one of the voice synthesizing unit 12 and the accumulated voice reproducing unit 13 with the data from the control unit 15. The control unit 15 controls this switching unit 14.

The control unit 15 integrally controls the individual element of the present voice response apparatus 10 and is constructed of the respective function blocks which operate as will be explained below.

A retrieval database storage part 21 serves to store a variety of databases accessed when performing the voice response serves. A data access part 22 extracts the data satisfying a retrieval condition indicated by an execution procedure control part 29 out of the database stored in the retrieval database storage part 21.

A work file storage part 23 serves to temporarily store a work file that is used when the present voice response apparatus operates. The work file is created by a data processing part 24. For example, when the database access part 22 retrieves the database, the data processing part 24 creates a result-of-retrieval file defined as the work file used when synthesizing the voices on the basis of the result of that retrieval.

FIG. 3 illustrates a structure of the result-of-retrieval file. Referring to FIG. 3, respective items from Address to Ending Time are items contained in the database as a retrieval target. Further, Delete and SEQ are items added by the data processing part 24 when creating the result-of-retrieval file. Both of Delete and SEQ are items referred when voice-outputting contents of the result-of-retrieval file. Sequence data for designating sequence to output are written in the item SEQ when creating the file. Output control data for designating whether the voice signal should be output or not are written in the item Delete during an implementation of the voice response serve.

Referring back to FIG. 1, the explanation of the function blocks constituting the control unit 15 will continue.

A narration file storage part 25 is a storage part for storing a narration file, i.e., data which is the basis of the voice signals transmitted to the user telephone 50. The narration file is divided into a voice accumulation file in which contents of the voice signals are prescribed by the voice coded data and a text file in which the contents of the voice signals are prescribed by the text data. The narration file storage part 25 stores these two types of files with different terms of their data forms.

A document creating part 26 incorporates a function to output contents of the text file or the accumulation voice file stored in the narration storage part 25 and a function to create and output a document (text data) in a colloquial mode by combining several sets of text data. The document creating part 26 operates in accordance with an indication given from the execution procedure control part 29.

A narration story file storage part 27 stores a narration story file defined as model information on question/answer procedures conducted between the present voice response apparatus 10 and the user telephone 50. A narration story file relative to the services performed by the present voice response apparatus is stored beforehand in this narration story file storage part. The narration story file is a program file. Defined in the narration story file is a procedure of executing three kinds of basic processes named a narration reading process, a push button data reading process and a database access process.

A narration story analyzing part 28 reads the narration story file within the narration story file storage part 27 and converts this file into data in a mode understandable by the execution procedure control part 29. Then, the execution procedure control part 29 integrally controls the respective parts in accordance with the data output by the narration story analyzing part 28, thereby actualizing the voice response service between the user telephones 50.

Hereinafter, the narration reading process, the push button data reading process and the database access process will be explained in sequence with reference to FIG. 4. Note that FIG. 4 is a diagram schematically showing the contents of the narration story file used in the case of conducting a goods order receiving service in the present voice response apparatus. Referring to FIG. 4, in a procedure of a process classification being (1), the narration reading process is executed. In procedures of the process classification being (2) and (3), the push button data reading process and the database access process are respectively executed.

The Narration Reading Process is now explained.

The narration reading process is a process of outputting the voice signal to the user telephone 50. For indicating an execution of this process in the narration story file, information specifying the data as a basis of the voice signal is given in the form of an operand. The execution procedure control part 29 executes the narration reading process corresponding to a content of the operand.

For instance, as in the procedure 1, when a voice accumulation file name "open.pcm" is described as an operand, the execution procedure control part 29 controls the document creating part 26 and the switching unit 14, thereby supplying the accumulated voice reproducing unit 13 with contents of the designated voice accumulation file. Then, a voice signal corresponding to the content of the voice accumulation file is output to the accumulated voice reproducing unit 13 and transmitted therefrom to the transmitting/receiving unit 11.

Further, in the case of describing text data (procedures 2, 7, etc.) or a text file name (procedure number 17) as operand, the execution procedure control part 29 controls the document creating part 26 and the switching unit 14, thereby supplying the voice synthesizing unit 12 with the text data thereof or the contents (text data) of the text file containing the text file name thereof that is stored in the narration file storage part 25. Ensuingly, the voice signal corresponding to the text data is output to the voice synthesizing unit 12 and then transmitted therefrom to the transmitting/receiving unit 11.

It is to be noted that the variable name or the item name of the result-of-retrieval file can be described in the text data used as an operand according to the present voice response apparatus. If an indication containing such an operand is given, the execution procedure control part 29 causes the document creating part 26 to create the text data wherein a corresponding variable or an actual content of the item is inserted in an area described with the variable name or in the item name.

For instance, as in the procedure number 5, if variable names such as "Code-user" and "Name-user" are described in the text data, the execution procedure control part 29 controls the document creating part 26, so that the document creating part 26 creates a piece of text data (e.g., No. 651123, are you Tokkyo Taro?) by inserting contents of respective variables, 651123 and Tokkyo Taro in the areas written with the variable names.

When reading the content of the result-of-retrieval file shown in, e.g., FIG. 3, as an operand, there is described the file name of the text file having such a content that No. (SEQ), an address is (address), a number of employees (scale), an industrial classification is (industrial-classification), a type of job is (job-classification), wages from (minimum-wages) up to (maximum-wages) and duty hours from starting-time to ending time. If such an indication is given, the execution procedure control part 29 controls the document creating part 26 so as to create the text data wherein each item data of the result-of-retrieval file is inserted in the bracketed area. Then, it makes the voice synthesizing unit 12 synthesize the voice signal corresponding to the text data created by the document creating part 26.

Note that if the result-of-retrieval file includes plural sets of retrieved results, the execution procedure control part 29 converts the respective retrieved results stored in the result-of-retrieval file into voice signals in the sequence of values of (SEQ), thereby reading the result-of-retrieval file. The voice response apparatus reads the result-of-retrieval file excluding the retrieved result wherein the output control data indicating that no voice signal is outputted is written in the item Delete.

According to the present voice response apparatus, when indicating the execution of the narration reading process in the narration story file, the voice accumulation file name and the text data or two kinds of text file names can be described as the operand. The execution procedure control part 29 executes the narration reading process by use of the operand corresponding to a value of a parameter "$F_{MODE}$" held therein.

In the present voice response apparatus, the content of each operand is set to read any one of the narration indicating the content of which the user is informed in detail and the narration as a summary thereof.

For example, if the content of the narration using one operand states: "We brief you on the present situation of the labor market. Incidentally, each value has already been seasonally adjusted. Looking at the nationwide labor market as of December in 1993, the effective job hunters decreased by 0.4% against the previous month, while the effective job offers decreased by 0.9% against the previous month. The effective job offer rate is 0.65 times, which is well balanced with the previous month. Let's itemizes this, the effective job offer rate of the part-time jobs is 1.03 times, but the effective job offer rate excluding the part-time jobs is 0.6 times. Further, the new job offers as of December decreased by 13.6% against the same month in the previous year." The content of another operand is set to narrate the following: Briefing the present labor market as of December in 1993, the effective job hunters decreased by 0.4% against the previous month, while the effective job offers decreased by 0.9% against the previous month. The effective job offer rate is 0.65 times."

According to the present voice response apparatus, if the user depresses a predetermined push button during the execution of the narration reading process, the operand is changed over (the value of the parameter "$F_{MODE}$" is changed), and the narration reading mode is also changed. Further, if other push button is depressed, the narration reading mode is changed by varying the value of the above-mentioned parameter "$F_{SPD}$". Moreover, if another push button is depressed during the execution of the narration reading process, the apparatus starts to read the narration from a position corresponding to the depressed push button.

Those processes (the reading mode control process and the reading position control process) are executed in parallel to the narration reading process, but a detailed explanation will be given later.

The Push Button Data Reading Process is now explained.

A push button data reading process is a process of recognizing the push button selected on the user telephone 50. When indicating an execution of this process, a piece of information for designating how the obtained push button data is used is described in the narration story file.

In the case of employing the push button data in order to input the data, there are described variable names for storing a series of push button data and a piece of information for determining what condition to satisfy for completing the data input. The execution procedure control part 29 determines a delimiter of the data conforming to that indication and stores the obtained data corresponding to a designated variable.

For instance, when an indication as in the procedure 3 is to be given, the execution procedure control part 29 sequentially stores the push button data input. Then, when the sixth item of push button data is input, the six pieces of data stored therein are then stored in the variable "Code-user", thus finishing the procedure 3 (the operation proceeds to a next process).

In the case of using the push button data as a flag for a branch condition, as in procedure 6, a piece of information for indicating which number of the push button data and which corresponding procedure to execute is described in the narration story file. The execution procedure control part 29 makes branching in accordance with that indication.

The Database Access Process is now explained.

The database access process is a process of accessing the file within the voice response apparatus. This process is mainly used for accessing the database within the retrieval database storage part 21. When indicating an execution of this database access process, there is described what process to execute for which file (database) as an operand. On this occasion, if the number of pieces of data obtained as a result of the retrieval is determined, for example, as in the procedure 4, the variable "Name-user" for storing the retrieved result together with the retrieval condition is designated.

As in the case of the normal database retrieval, a name of the file for storing the retrieved result is designated. When receiving such a designation, the execution procedure control part 29 controls the database access part 22 and the data processing part 24 so that a retrieved result file (see FIG. 3) having the designated file name is created.

Figure 5:
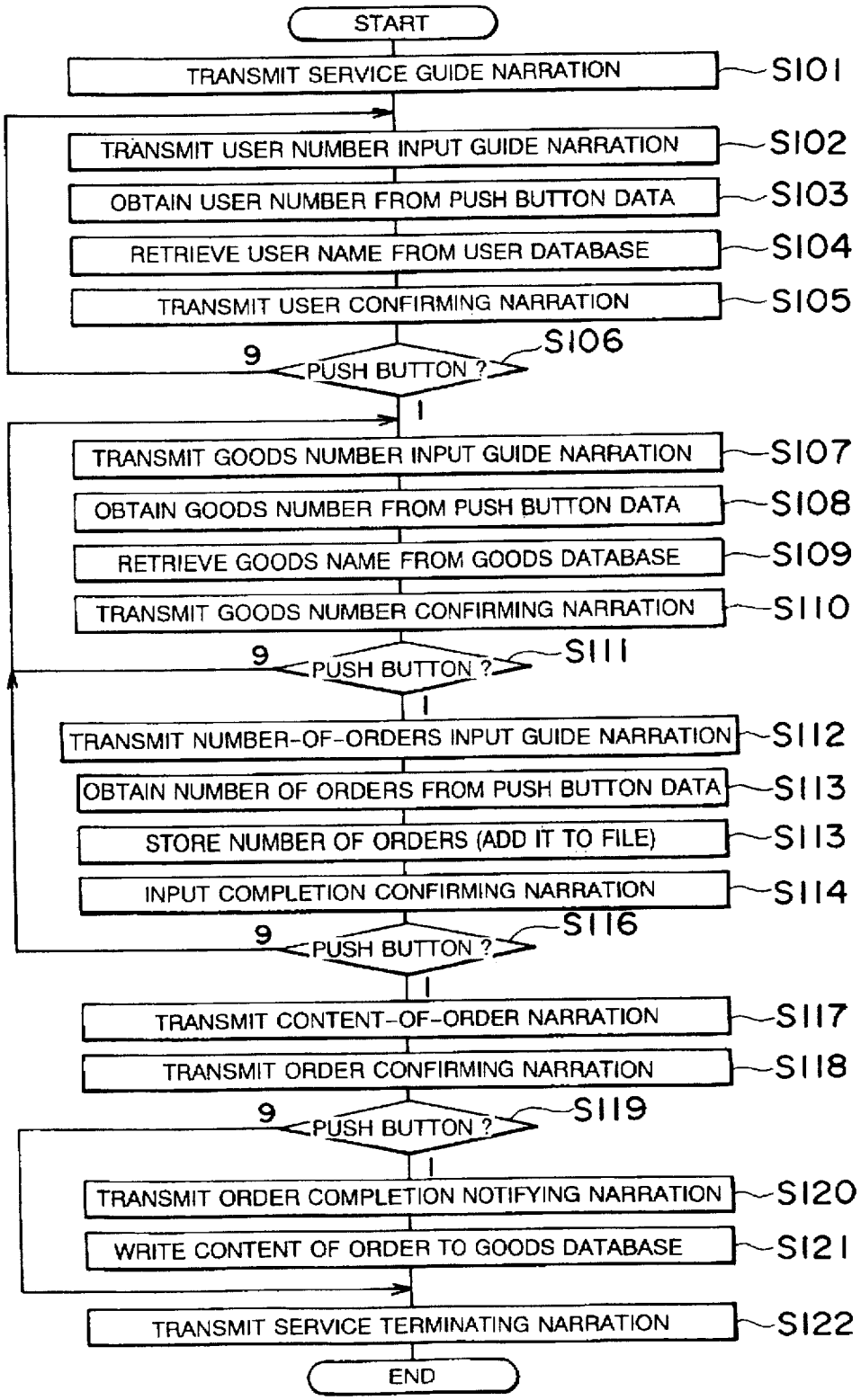
FIG. 5 is a flowchart showing operating procedures when implementing the goods ordering service in the voice response apparatus in the first embodiment of the present invention.
Figure 6:
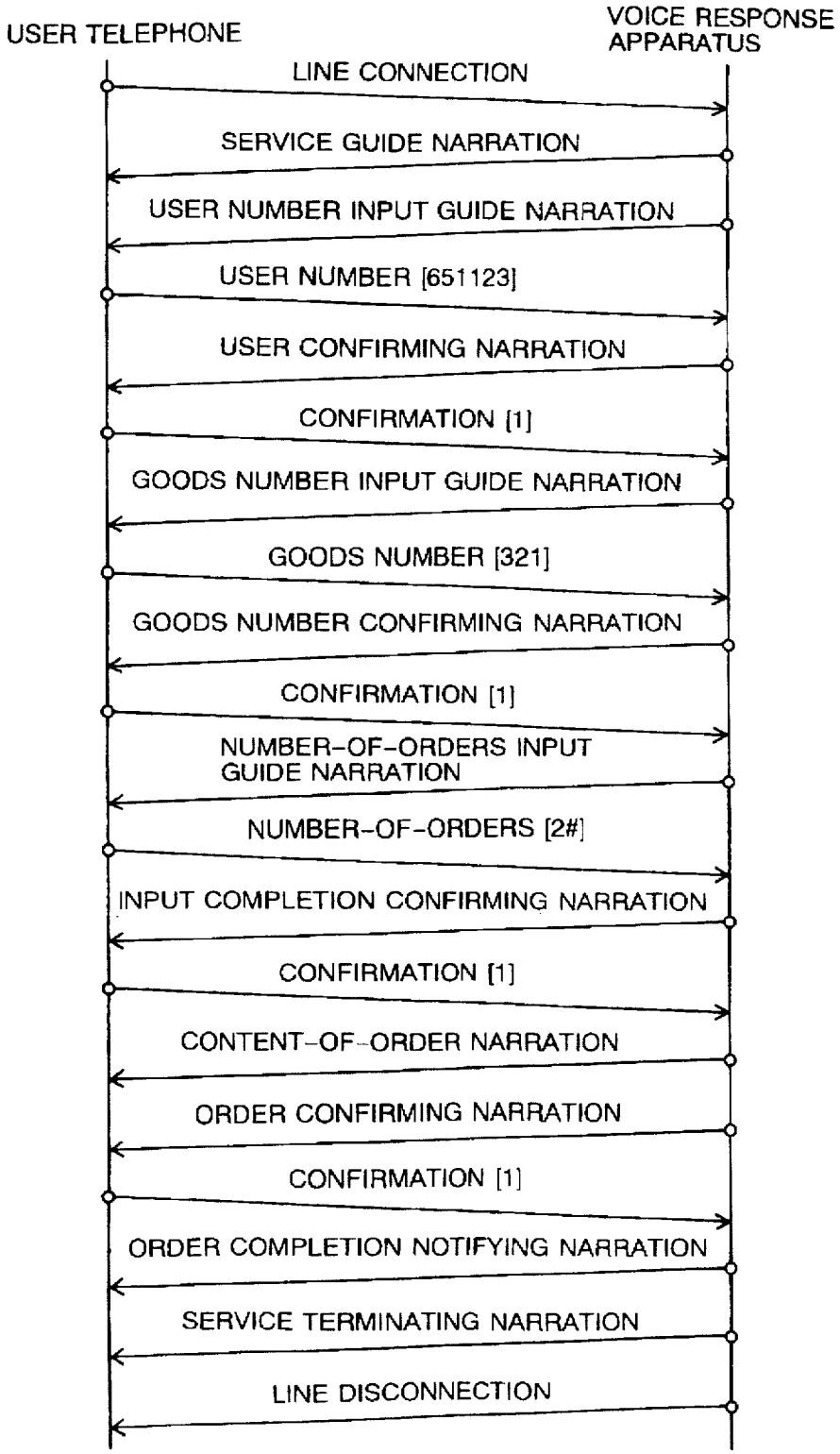
FIG. 6 is a diagram showing a signal sequence when implementing the goods ordering service in the voice response apparatus in the first embodiment of the present invention.
Figure 7:
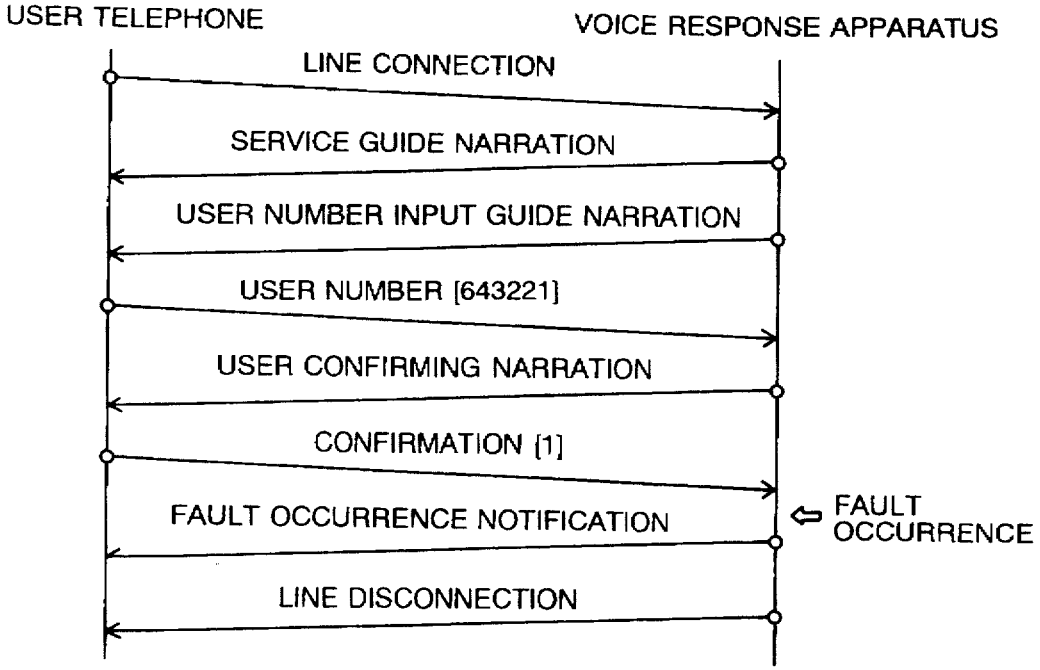
FIG. 7 is a diagram showing a signal sequence when a fault happens in the voice response apparatus in the first embodiment of the present invention.

In the long run, when the narration story file shown in FIG. 4 is executed (when a goods ordering service is implemented), it follows that the present voice response apparatus operates as illustrated in FIGS. 5 and 6. Note that FIG. 5 of these Figures is a flowchart showing operating procedures of the present voice response apparatus when implementing the goods ordering service. Low-order two digits of numerical values contained in the symbols such as "S101"–"S122" shown in this flowchart are procedure numbers of the corresponding procedures in the narration story file shown in FIG. 4. FIG. 6 is a diagram showing a signal sequence of the voice signal and a tone signal that are transferred and received between the present voice response apparatus and the user telephone when implementing the goods ordering service.

As illustrated in FIG. 5, when implementing the goods ordering service, the voice response apparatus transmits a service guide narration by reproducing a content of "open-.pcm" serving as a voice accumulation file (step S101). Then, a piece of text data (For Example: "Input the user's number, please.") is voice-signalized, thereby transmitting a user's number input guide narration (step (S102).

That is, as shown in FIG. 6, after connecting the line to the present voice response apparatus, the user telephone outputs voices of the service guide narration and the user's number input guide narration. Subsequently, as a response to those narrations, it follows that the user inputs a user's number (i.e., 651123) by operating the push button.

After transmitting the user's number input guide narration, the voice response apparatus shifts to a status of waiting for input of the push button and obtains a series of the push button data from the user telephone in the form of user's number (step S103). According to the procedure 3 of the narration story file, there is given an indication to determine the data input completion when six pieces of push button data are input. Accordingly, when the user depresses the push button in the sequence of 651123, the voice response apparatus determines that the data input is completed at such a stage that the sixth piece of data (3) is input. Then, the 6-digit data 651123obtained as a user's number, and step S104 is started.

In step S104, the database is retrieved by use of the user's number acquired in step S103, and a user's name corresponding to the user's number is retrieved. Subsequently, the voice response apparatus transmits a user confirming narration containing the user's number and the user's name to the user telephone (step S105).

As a result of this transmission, the user telephone outputs voices of the user confirming narration (e.g., No. 651123, are you Tokkyo Taro?). The user, after hearing this narration, depresses the push button "9" or "1", thereby giving an indication to the voice response apparatus as to whether or not the user's number is re-input.

The voice response apparatus, after transmitting the user confirming narration, has shifted to the status of waiting for the input of the push button data, and, when detecting that the push button "9" is depressed (step S106; 9), the processes from step S102 are to be reexecuted.

Further, when detecting that the push button "1" is depressed (step S106; 1), as shown in FIG. 6, there is transmitted a goods number input guide narration such as "Input the goods number, please." (step S107). Subsequently, the apparatus shifts to a status of waiting for an input of a goods number (step S108). In step S108, the individual pieces of push button data to be input are stored, and the number of inputs is counted in the voice response apparatus. As indicated by the procedure 8, the voice response apparatus, when the third push button data is input, determines that the input of the goods number is completed and obtains the 3-digit push button data as the goods number.

Next, the voice response apparatus retrieves a name of goods having the acquired goods number from a goods database (step S109). Then, the voice response apparatus transmits a goods number confirming narration containing the goods number and the goods name as a result of the retrieval (step S110). Thereafter, the apparatus shifts to a status of waiting for an input of the push button data, and when detecting that the push button "9" is depressed (step S111; 9), the processes from step S107 are to be reexecuted to re-input the goods number.

Further, when detecting that the push button "1" is depressed (step S111; 1), the apparatus transmits a number-of-orders input guide narration such as "Input the number of orders, please." (step S112). Thereafter, the apparatus shifts to a status of waiting the input of the push button data and acquires the number of orders (step S113). In this step S113, as indicated by the procedure 13, when the push button data corresponding to "#" is input, the apparatus determines that the input of the number of goods is completed.

After completing the input of the number of orders, the voice response apparatus stores the thus obtained number of orders by relating it to the goods number obtained in step S108 (step S114). The storage in this step S114, as indicated by the procedure 14 of FIG. 4, is performed by adding a piece of text data "I order Num-goods pieces of Name-goods having a Code-goods number." to a text file "order.txt". Transmitted subsequently is an input completion confirming narration "Is that all right?" (step S115).

Thereafter, the apparatus shifts to a status of awaiting input of indicating whether or not other goods are ordered, and, when detecting that the push button "9" is depressed (step S116; 9), the processes from step S107 are reexecuted to obtain the information on other goods to be ordered.

In the case of detecting that the push button "1" is depressed (step S116; 1), the content of the text file "order.txt" is voice-signalized, thereby transmitting a content-of-order narration (step S117). Thereafter, the apparatus transmits an order confirming narration "Can we send out the order?" (step S118).

For example, if only two pieces of goods with a goods number 321 are ordered, as shown in FIG. 6, after outputting voices of an input completion confirming narration, the user depresses the push button "1". In this case, the text file "order.txt" stores only the data about one type goods, and the content of the "order.txt" is voice-output as the content-of-order narration. The user, after hearing the content-of-order narration and the order confirming narration, depresses the push button "1" or "9", thus indicating whether or not sending out the order is executed with the content of the content-of-order narration.

The voice response apparatus, after transmitting the order confirming narration (step S118), shifts to a status of waiting for an input of push button data and transmits, when detecting that the push button "1" is depressed (step S119; 1), an order completion notifying narration indicating "The order has been sent out." (step S120). Subsequently, the content of the order is written to the goods database with reference to "order.txt" (step S121). Then, a service terminating narration is transmitted (step S122) by reproducing "close.pcm" as the accumulated voice file, thus finishing the goods ordering service.

Further, when detecting that the push button "9" is depressed (step S119; 9), the service terminating narration is transmitted without actually sending out the order (step S122), and the goods ordering service is finished. Then, as illustrated in FIG. 6, the line is disconnected.

Note that if the voice response service cannot continue due to a fault caused in the voice response apparatus, as illustrated in FIG. 10, the voice response apparatus notifies the user telephone of the occurrence of the fault at the stage of detecting the fault and disconnects the line.

Given hereinafter is a detailed explanation of a reading mode control process and a reading position control process that are executed in parallel to the narration reading process.

The Reading Mode Control Process is now explained.

According to the present voice response apparatus, the reading (uttering) mode is changed by switching a reading speed or a content of a document to be read. To start with, referring to FIG. 1, there will be explained how the reading speed or the content of the document to be read is changed in the present voice response apparatus.

The voice synthesizing unit 12 is, as explained above, constructed to make the reading speed variable. The voice synthesizing unit 12 receives a parameter "$F_{SPD}$" for specifying the reading speed from the control unit 15 and reads the text data at a speed corresponding to this parameter.

Further, the content of the document to be read is varied by switching over the operand used when effecting the narration reading process. Information for specifying which operand to use is stored in the form of "$F_{MODE}$" in the execution procedure control part 29. The execution procedure control part 29, when starting the narration reading process, refers to a value of the parameter "$F_{MODE}$" and causes the document creating part 26 to use an operand corresponding to this value.

Figure 8:
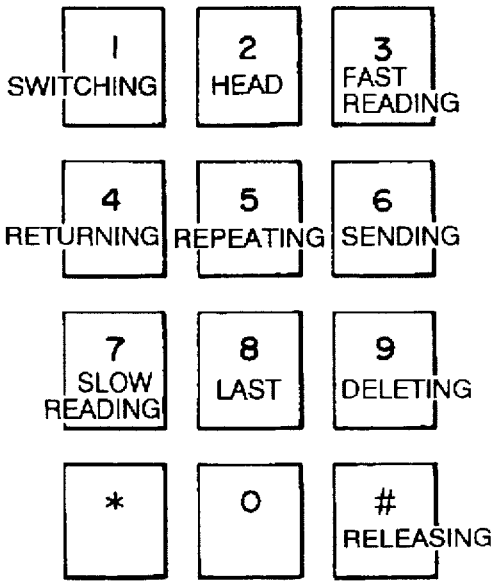
FIG. 8 is an explanatory diagram illustrating a correspondence relationship of each push button of a user telephone versus an operating indication in the voice response apparatus in the first embodiment of the present invention.
Figure 9:
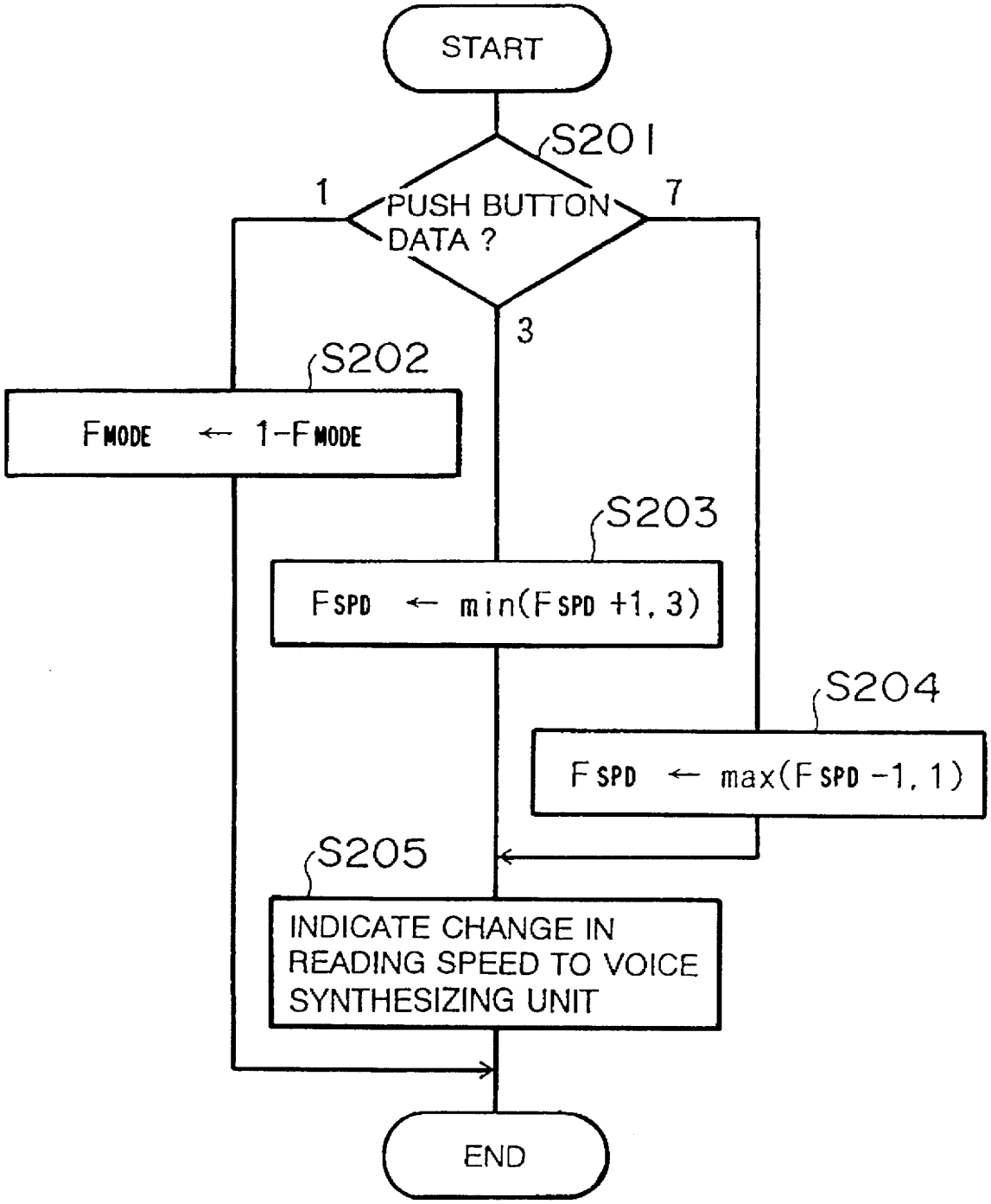
FIG. 9 is a flowchart showing operating procedures of an execution procedure control part when giving an operating indication for controlling a reading mode in the voice response apparatus in the first embodiment of the present invention.

Referring to FIGS. 8 and 9 a procedure of changing the values of the parameters "$F_{SPD}$" and "$F_{MODE}$" will be explained. As illustrated in FIG. 8, a kind of operating indication (instruction to the voice response apparatus) is allocated to each of the push buttons of the user telephone 50. Among those operating indications, Switching, Fast Reading and Slow Reading allocated to the push buttons "1", "3" and "7" are defined as operating indications for controlling the reading mode. If the user depresses these push buttons during the execution of the narration reading process, the execution procedure control part 29, changes the reading mode (values of "$F_{MODE}$" and "$F_{SPD}$") in accordance with the operating procedures shown in FIG. 9.

As shown in FIG. 9, if the push button data input during the execution of the narration reading process is "1" (step S201; 1), the execution procedure control part 29 sets "1-FMODE" to a content of "$F_{MODE}$" (step S202) and finishes the process of inputting the push button data.

That is, when detecting the push button data "1", the execution procedure control part 29 only stores the fact that the content of "$F_{MODE}$" is changed. Then, when the narration is read up to a predetermined delimiter, the execution procedure control part 29 indicates the document creating part 26 to change the reading mode (to change the operand in use).

Described, for instance, in the result-of-retrieval file shown in FIG. 3 is a file name of the text file having a content: "The number (SEQ) has an address of (address), (scale) employees, a sector of (industrial classification), a type of job as (job classification), wages of (minimum wages) through (maximum wages), duty hours from starting time to ending time" as a first operand. Further, as a second operand, there is described a file name of the text file having content of: "The number (SEQ) has an address of (address), a sector of (industrial classification), a type of job as (job classification), wages of minimum wages through maximum wages, duty hours from starting time to ending time. " It is considered that the user depressed the push button "1" during a read of the first retrieved result.

In this case, the execution procedure control part 29 does not change the reading mode up to the completion of outputting of such voices. For example: "The number one has an address of Shinjuku-ku, 100 employees, a sector of the construction industry, a type of job as a painter, wages of 375,000 through 470,000 Yen, duty hours from 9:00 a.m. to 6:00 p.m.." Then, after completing the voice outputting for the first retrieved result, the voice response apparatus changes the reading mode. In consequence, results of the second and subsequent retrievals are read in a mode using a second operand such as "The number two has an address of Nakano-ku, a sector of equipment enterprise, a type of job as a plumber, wages of 400,000 through 550,000 Yen, duty hours from 8:30 a.m. to 5:30 p.m.."

If the push button data is "3" (step S201; 3), the execution procedure control part 29 sets a smaller value of "$F_{SPD}$+1" and "3" in "$F_{SPD}$" (step S203). That is, the execution procedure control part 29, when the value of "$F_{SPD}$" is 2 or under, increments this value by "1". Also, when the value of "$F_{SPD}$" is "3", the execution procedure control part 29 does not change this value but keeps it. Then, the execution procedure control part 29 indicates the voice synthesizing unit 12 to change the reading speed so that the reading speed of the voice data output from the transmitting/receiving unit 11 becomes a speed corresponding to the value "$F_{SPD}$" (step S205).

If the push button is "7" (step S201; 7), the larger value of "$F_{SPD}$1−" and "1" is set in "$F_{SPD}$" (step S204). More specifically, if the value of "$F_{SPD}$" is 2 or larger, this value is decremented by "1". Further, if the value of "$F_{SPD}$" is 1, this value is not changed but kept as is. Given subsequently to the voice synthesizing unit 12 is an indication of changing the reading speed so that the reading speed of the voice data output from the transmitting receiving unit 11 becomes a speed corresponding to the value of "$F_{SPD}$" (step S205).

It is to be noted that the change in "$F_{MODE}$" in step S202 is, though not clearly shown in this flowchart, performed only when the narration reading process on the execution at that time contains two kinds of operand. Further, the processes of steps S203 through S205 are conducted only when the narration reading process on the execution at that time involves the use of the voice synthesizing unit 12.

As discussed above, according to the present voice response apparatus, when the user manipulates the push button to indicate Switching, the reading mode is switched. When the user indicates the Fast Reading or Slow Reading, the reading speed is varied higher or lower by one stage. That is, the present voice response apparatus is capable of reading using, as illustrated in FIG. 10, six types of reading modes by combining the reading modes with the reading speeds. Accordingly, the user of the present voice response apparatus selects the reading mode corresponding to the content of the narration that is being read and is thus able to utilize the voice response service.

The Reading Position Control Process is now explained.

Figure 11:
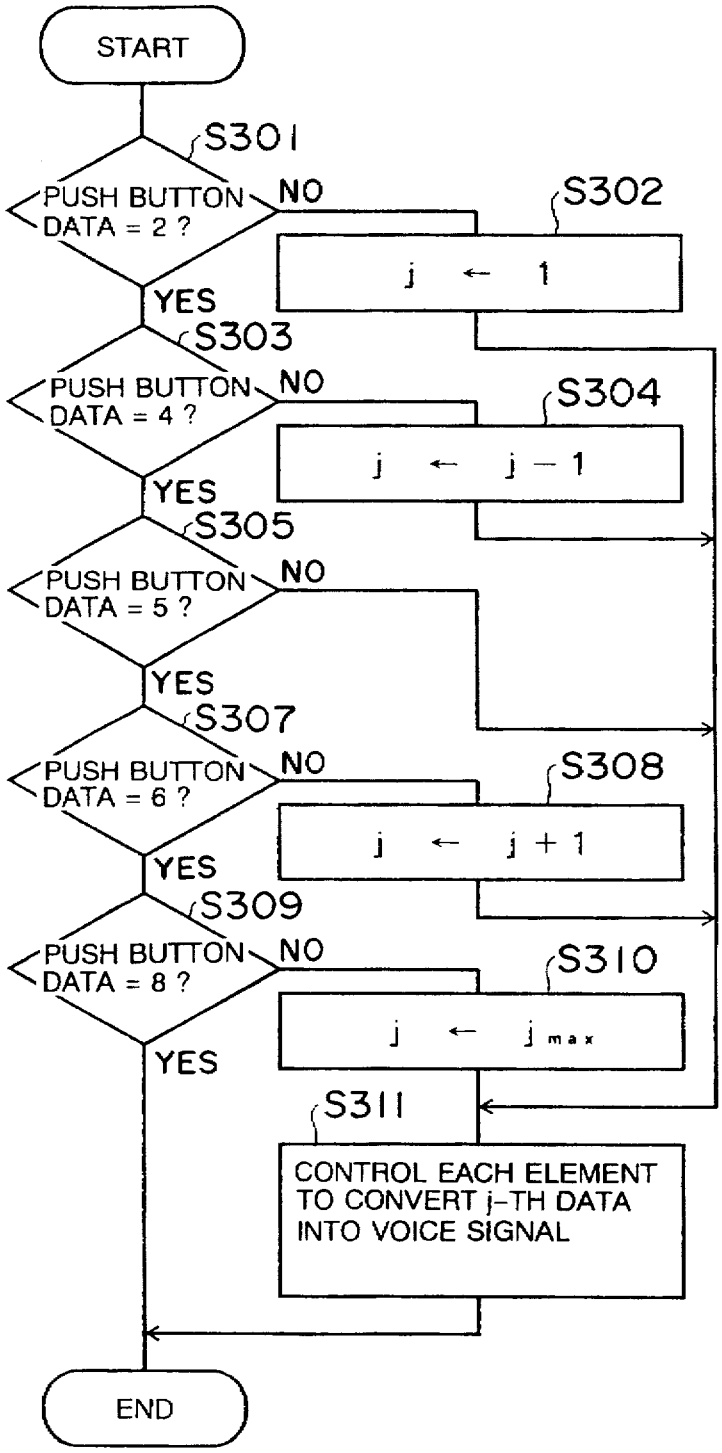
FIG. 11 is a flowchart showing operating procedures of the execution procedure control part when giving an operating indication for controlling a reading position in the voice response apparatus in the first embodiment of the present invention.

Hereinafter, the reading position control process will be explained in greater detail with reference to FIGS. 8 through 11. Remaining seven operating indications (FIG. 8) allocated to the push buttons serve to control reading positions. Among those operating indications, when depressing the push buttons to which Head, Returning, Repeating, Sending and End are allocated, the execution procedure control part 29 operates as illustrated in FIG. 11.

In the case of detecting the push button "2" (Head) (step S301; Y), the execution procedure control part 29 sets "1" in a variable "j" for storing information specifying the data to be read next (step S302). Then, the document creating part 26 or the like is controlled, thereby interrupting the supply of the text data to the voice synthesizing unit 12 but converting the j-th data (e.g., the j-th retrieval result of the result-of-retrieval file) into a voice signal (step S311).

In this step S311, if the text data exclusive of the result-of-retrieval file is a target for reading, the execution procedure control part 29 controls the respective elements so that each document delimited by a period (.) in that text data is dealt with as a single piece of data and the j-th document is converted into the voice signals.

When detecting the push button data "4" (Returning) (step S303; Y), a value "j−1" obtained by subtracting "1" from the content of the variable "j" stored with the information for specifying the data that is now being read is set in the variable "j" (step S304), and the processing proceeds to step S311. When detecting the push button data "5" (Repeating) (step S305; Y), the value of the variable "j" is not varied, and the processing proceeds to step S311.

In the case of detecting the push button "6" (Sending) (step S307; Y), "j+1" is set in the variable "j" (step S308), and the processing proceeds to step S311. When detecting the push button data "8" (Last) (step S309; Y), a data total number "$J_{max}$" (or a total number of documents contained in the text data) of the result-of-retrieval file that is a target for reading at present is set in the variable "j" (step S310), and the processing proceeds to step S311.

Figure 12:
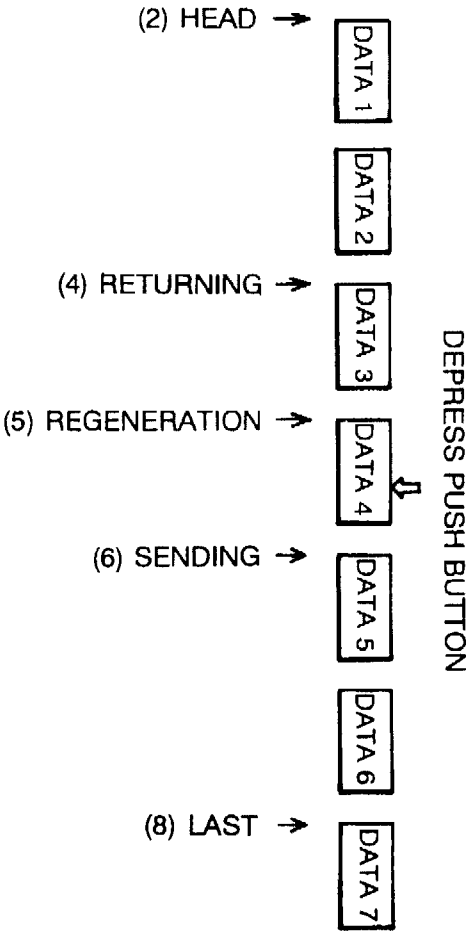
FIG. 12 is an explanatory diagram showing one example of an operation result when giving an operating indication for controlling a reading portion in the voice response apparatus in the first embodiment of the present invention.

For example, when reading the 4th data of the result-of-retrieval file containing the seven pieces of data, and if the push button for controlling the reading positions thereof is depressed, as schematically illustrated in FIG. 12, the data are read sequentially from the head "data 1" in the case of that push button being "2". Then, when the push button is "4", the data "3" positioned one before the "data 4" that is being read at that time.

Further, if that push button is "5", it follows that the "data 4" is reread, and, when the push button is "6", reading the data is started from the "data 5" positioned one posterior thereto. Then, when the push button is "8", the data are read from the "data 7" defined as the last data.

Thus, the present voice response apparatus is constructed so as to stop the voice-outputting of the unnecessary data and to voice-output again the necessary data by manipulating the push button. Therefore, the user is capable of efficiently using the voice response services by use of those functions.

The five types of push buttons described above are constructed to always give the effective operating indications during the narration reading process.

In contrast with this, a (Delete) indication and a (Releasing) indications (see FIG. 8) allocated respectively to the push buttons "9" and "#" are the operating indications effective only in the case of reading the contents of the result-of-retrieval file. When detecting the depressions of those push buttons, the execution procedure control part 29 operates as follows.

When detecting the depression of the push button "9", the execution procedure control part 29 writes the output control information for indicating that the voices are not output in the item (Delete) of the data that is now being read. Further, when detecting the depression of the push button "#", the execution procedure control part 29 clears the content of each item (Delete) of the result-of-retrieval file that is now being read.

For instance, these two operating indications are used as follows.

When the contents of a result-of-retrieval file is started to be voice-outputted, the user, at first, depresses the push buttons "1" (Switching) and "3" (Fast Reading). In accordance with these instructions, the voice response apparatus starts to read the contents of the result-of-retrieval file fast in an essential point reading mode. Subsequently, the user decides whether or not that piece of data is required by hearing the read content. If the data is required, the user depresses the push button "6" (Sending). If the data is not required, the user depresses the push button "9" (Delete) and depresses the push button "6".

In the former case, the voice response apparatus omits the voice-outputting of the remaining parts in the data and starts voice-outputting the next data of the result-of-retrieval file. In the latter case, the apparatus writes an output control information indicating that no voice outputting in the (Delete) of corresponding data of the result-of-retrieval file and skips the voice-outputting the remaining parts of the data.

As already discussed above, in the narration reading process of the result-of-retrieval file, if the output control information indicating that no voice outputting exists in the (Delete), the read of the data is omitted. Accordingly, the user, by depressing the push button "2" (Head) after performing the above operations with respect to the series of data, can get essential information without hearing the whole contents of the result-of-retrieval file.

The Second Embodiment of the present invention is now explained.

Figure 13:
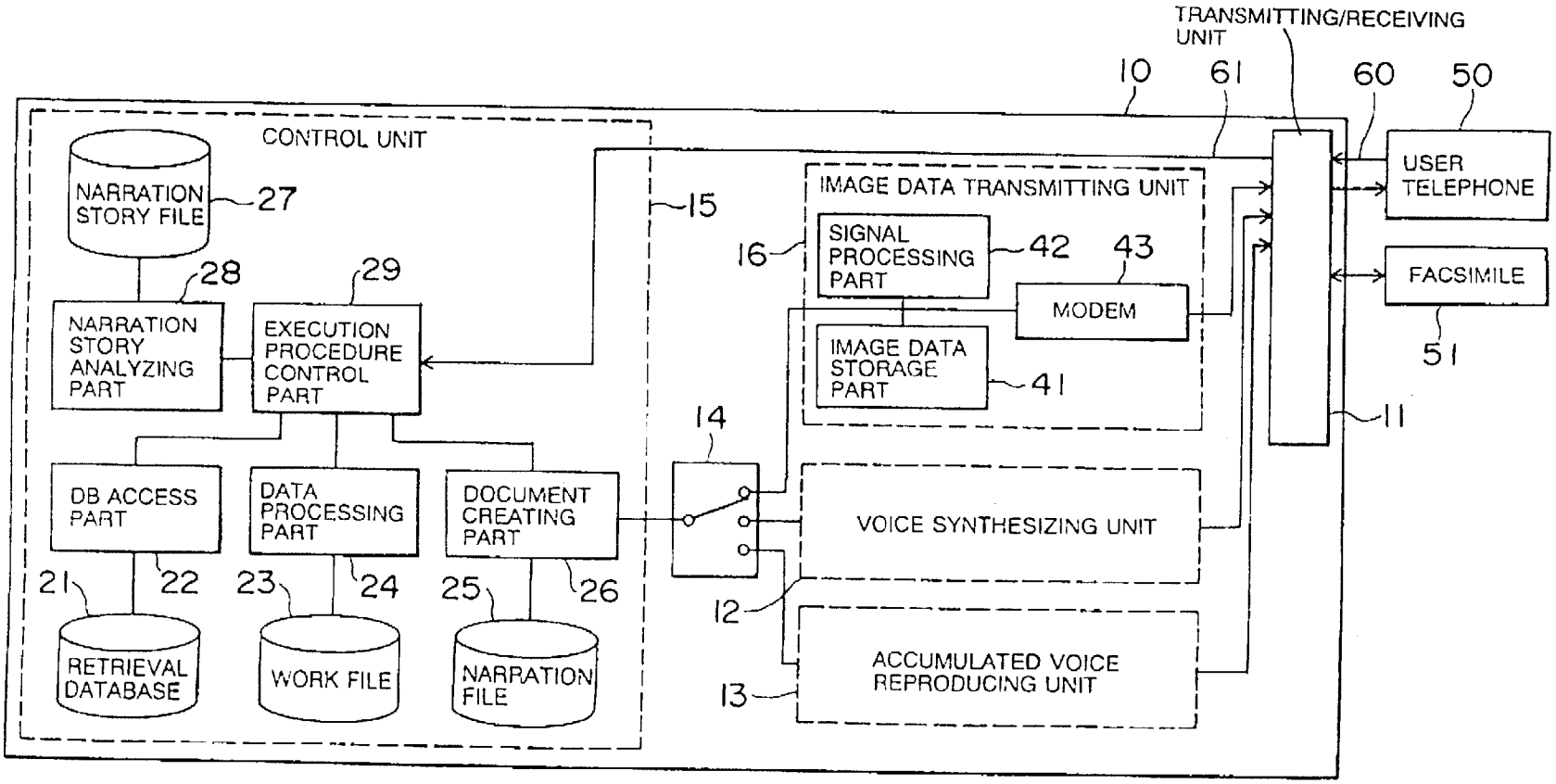
FIG. 13 is a block diagram illustrating a construction of the voice response apparatus in a second embodiment of the present invention.

FIG. 13 illustrates a construction of the voice response apparatus in accordance with a second embodiment of the present invention. As illustrated in FIG. 13, the voice response apparatus in the second embodiment has such a construction that a image data transmitting unit is added to the voice response apparatus in the first embodiment. This voice response apparatus 10 is connected to the user telephone 50 and a facsimile 51 as well.

The image data transmitting unit 16 is constructed of a image memory 41, a signal processing part 42 and a MODEM 43 and is provided between the transmitting/receiving unit 11 and the switching unit 14. The image data storage part 41 temporarily stores image data to be transmitted to he facsimile 51. The signal processing part 42 performs a process of reducing a redundancy contained in the image data stored in the image data storage part 41. The MODEM 43 modulates the image data processed by the signal processing part 42 and outputs the modulated image data.

Added to the control unit 15 is a function to convert the text data, which are to be output in the form of the voice signals, into image data and supply the image data storage part 41 with the thus converted image data. The control unit 15, if a predetermined condition is satisfied, executes the conversion into the image data. Thereafter, the control unit 15 controls the signal processing part 42 and the MODEM 43, whereby the image data stored in the image data storage part 41 are output to the facsimile 51.

A facsimile output indicating procedure used in the voice response apparatus in the second embodiment will hereinafter be explained.

The voice response apparatus in the second embodiment, when the user depresses the push button "*" during the narration reading process, stores the fact that the narration should be output to the facsimile. Then, if the facsimile output is indicated during an execution of the voice response service, there is effected a narration for making a prompt to input a facsimile number the finishing the voice response service, and the facsimile number is obtained from the push button data. Subsequently, after connecting a call to the facsimile number, the image data transmitting unit 16, whereby a content of the narration stored with the facsimile output being performed is outputted to the facsimile 51.

Thus, the voice response apparatus in the second embodiment is capable of outputting the content of the narration to the facsimile, and therefore, the user of the present voice response apparatus determines the data to be output in the essential point reading mode and examines the details of the content through the facsimile outputting.

Modified Examples of First and Second Embodiments are now presented.

According to the two kinds of embodiments discussed above, there are prepared the independent data for reading the whole documents and or the essential points, respectively. The voice response apparatus can be, however, constructed in such a way that control codes are included in the text data, and when reading the whole documents, all the text data is used; but when reading the essential points, only the portions designated by the control code are used.

One example of such a narration follows: "We brief you on the " CODE1 present situation of the labor market. "CODE2" Incidentally, each value has already been seasonally adjusted. Looking at the nationwide labor market "CODE1" as of December in 1993, the effective job hunters decreased by 0.4% against the previous month, while the effective job offers decreased by 0.9% against the previous month. The effective job offer rate id 0.65 times, "CODE2" which is well balanced with the previous month. Let's itemizes this, the effective job offer rate of the part-time jobs is 1.03 times, but the effective job offer rate excluding the part-time jobs is 0.6 times. Further, the new job offers as of December decreased by 13.6% against the same month in the previous year." Another example of such a narration is: "Present situation of the labor market. As of December in 1993, the effective job hunters decreased by 0.4% against the previous month, while the effective job offers decreased by 0.9% against the previous month. The effective job offer rate id 0.65 times." This second narration excludes the control codes "CODE1" and "CODE2" with the documents interposed between the control codes "CODE1" and "CODE2".

Further, through constructed to change the reading mode by independently changing the reading speed and the reading mode, the apparatus may be constructed so that one (or more) push button is allocated to each reading mode shown in FIG. 10, and the reading speed and the reading mode are simultaneously changed.

Further, the audio response apparatus in each embodiment is constructed so as not to control the reading speed and the reading position if the voice accumulation file is a target for reading the narration. The voice response apparatus can be, however, constructed so that a plurality of voice accumulation files having different reading speeds are prepared and selected for reproduction corresponding to the depressed push buttons. Furthermore, the plurality of voice accumulation files are prepared for one narrating process, and, with this preparation, the reading position may be controlled with respect to the voice accumulation file. Also, the reading position can be controlled with respect to segment the data stored in the voice accumulation file at unrecorded areas.

The voice response apparatus in the first and second embodiments involve the use of the voice synthesizing unit for synthesizing the voices by the rule synthesizing method. As illustrated in FIG. 14, however, the voice synthesis based on the rule synthesizing method is capable of expressing any kinds of narrations (an infinite number of vocabularies), inferior to others in terms of an understandability and naturalness. Further, when adopting the voice synthesis based on the rule synthesis method, the apparatus becomes complicated. As explained above, voice synthesis based on the rule synthesizing method has disadvantages as well as exhibiting advantages. The voice synthesis method adopted in the voice synthesis unit should be the one corresponding to an application for use. For example, if the content of the voice-outputted narration is limited, there is used the voice synthesis unit for synthesizing the voices by a recorded speech compiling method and a parameter editing method, whereby the audio response apparatus excellent in terms of economical property and recognizability as well can be formed.

The voice response apparatus in the second embodiment is constructed to output the data prepared for reading the narration to the facsimile. However, the audio response apparatus may be, as a matter of course, constructed to hold the image data (about e.g., a map) relative to the content of the response service and output the image data to the facsimile.

As this invention may be embodied in several forms without departing from the spirit of essential characteristics thereof, the present embodiment is therefore illustrative and not restrictive, since the scope of the invention is defined by the appended claims rather than by the description pending them, and all changes that fall within meets and bounds are therefore intended by the claims.

What is claimed is:

1. A voice response apparatus connected via a communication line to a user telephone, said apparatus comprising:

storage means for storing narrative information;

transmitting means for generating a voice signal corresponding to the narrative information stored in said storage means and transmitting the generated voice signal to said user telephone via the communication line; and control means for monitoring said communication line for input of position specifying data from the user telephone occurring during the transmission of the narrative information by said transmitting means, and for causing said transmitting means to interrupt the transmission of the narrative information and to resume the transmission of the narrative information from a position specified by the position specifying data.

2. A voice response apparatus according to claim 1, wherein the narrative information comprises one or more pieces of document data having a predetermined usage sequence stored therein, said transmitting means generates the voice signals corresponding to each piece of said document data constituting the narrative information in an order based on a usage sequence, and said control means receives the input of the position specifying data specifying one piece of said document data constituting the narrative information and resumes the transmission of the narrative information from the document data specified by the position specifying data.

3. A voice response apparatus according to claim 2, wherein the narrative information further comprises output control data for determining whether each document data is output as voice signals, said transmitting means generates the voice signals corresponding to each piece of said document data indicating that the output control data is output in as voice signals among the document data constituting the narrative information, said transmitting means comprising:

rewriting means for rewriting said output data control data into data indicating that the voice signal output is not performed when a predetermined piece of first indication data is input from the user telephone via the communication line during transmission of the narrative information by said transmitting means.

4. A voice response apparatus according to claim 3, wherein said rewriting means rewrites a content of the output control data relative to all the document data in the narrative information into data indicating that the voice signal output is performed if a predetermined piece of second indication data is input from the user telephone via the communication line during the transmission of the narrative information by said transmitting means.

5. A voice response apparatus according to claim 1, wherein said storage means stores first narrative information and second narrative information used for a same service, said transmitting means generates the voice signals corresponding to one of the first narrative information and the second narrative information stored in said storage means, and said apparatus further comprises:

switching means for switching the narrative information used for the transmission by said transmitting means if third indication data is input from the user telephone via the communication line.

6. A voice response apparatus according to claim 5, wherein a content specified in the second narrative information is a summary of a content specified in the first narrative information.

7. A voice response according to claim 1, wherein said transmitting means generates the voice signals having utterance speeds on the basis of the narrative information, and said control means controls said transmitting means to generate the voice signal in one of the utterance speeds according to an indication to chance an utterance speed from the user telephone via the communication line during the transmission of narrative information by said transmitting means.

8. A voice response apparatus according to claim 1, wherein a content of the narrative information is defined by text data, and said transmitting means converts the narrative information into the voice signals by performing rule voice synthesis.

9. A voice response apparatus according to claim 1, wherein said storage means stores the narrative information a content of which is defined by text data and the narrative information a content of which is defined by the accumulation voice data, and said transmitting means converts the narrative information into the voice signals by performing rule voice synthesis when transmitting the narrative information the content of which is defined by the text data, and converts the narrative information into the voice signals by effecting waveform reproduction when transmitting the narrative information the content of which is defined by the accumulation voice data.

10. A voice response apparatus according to claim 8, further comprising:

a database; and retrieving means for creating said narrative information on the basis of a retrieval result of said database in accordance with a content of the indication from the user telephone and causing said storage means to store the thus created narrative information.

11. A voice response apparatus according to claim 8, further comprising:

facsimile signal transmitting means for creating image data on the basis of the narrative information to be transmitted by said transmitting means and transmitting facsimile signals corresponding to the created image data to the communication line.

12. A voice response apparatus according to claim 1, wherein the position specifying data is a tone signal.

13. A voice response apparatus according to claim 2, wherein the position specifying data the input of which is accepted by said control means comprises a portion of the position specifying data specifying the document data being transmitted.

14. A voice response apparatus according to claim 2, wherein the position specifying data the input of which is accepted by said control means comprises a portion of the position specifying data specifying a portion of document data next to the document data being transmitted.

15. A voice response apparatus according to claim 2, wherein the position specifying data comprises a portion of the position specifying data specifying a portion of document data positioned before the document data being transmitted.

16. A voice response apparatus according to claim 2, wherein the position specifying data comprises a portion of the position specifying data specifying a head document data of the narrative information being transmitted.

17. A voice response apparatus according to claim 2, wherein the position specifying data comprises a portion of the position specifying data specifying last document data of the narrative information being transmitted.

18. A voice response apparatus connected via a communication line to a user telephone, said apparatus comprising:

a voice synthesis unit generating a voice signal comprising narrative information retrieved from a database and transmitting said generated voice signal to said user telephone via said communication line; and a control unit monitoring said communication line for a user selected option from the user telephone while the voice synthesis unit is generating a voice signal, and causing said voice synthesis unit to interrupt the transmission of the narrative information and to resume the transmission of the narrative information from a position specified by said control unit.

19. A method of controlling a voice response system connected via a communication line to a user telephone, said method comprising the steps of:

generating a voice signal comprising narrative information retrieved from a database and transmitting said generated voice signal to said user telephone via said communication line;

monitoring said communication line for a user selected option from the user telephone while generating a voice signal; and interrupting the transmission of the narrative information and resuming the transmission of the narrative information from a position based on the user selected option.

* * * * *